US006152686A

United States Patent [19]

Neidhard et al.

[11] Patent Number: 6,152,686

[45] Date of Patent: Nov. 28, 2000

[54] EQUIPMENT FOR PUMPING FUEL FROM A STORAGE TANK TO THE INTERNAL-COMBUSTION ENGINE OF A MOTOR VEHICLE

[75] Inventors: Klaus Neidhard, Weil der Stadt; Michael Huebel, Gerlingen; Wille Strohl, Beilstein; Jochen Rose, Hemmingen, all of Germany

[73] Assignee: Robert Bosch GmbH, Stuttgart, Germany

[21] Appl. No.: 08/983,623

[22] PCT Filed: Feb. 13, 1997

[86] PCT No.: PCT/DE97/00272

§ 371 Date: Jan. 22, 1998

§ 102(e) Date: Jan. 22, 1998

[87] PCT Pub. No.: WO97/46809

PCT Pub. Date: Dec. 11, 1997

[30] Foreign Application Priority Data

Jun. 5, 1996 [DE] Germany ..... 196 22 560

[51] Int. Cl.[7] ..... F01D 3/00

[52] U.S. Cl. ..... 415/55.1; 415/55.5

[58] Field of Search ..... 415/55.1, 55.2, 415/55.3, 55.4, 55.5, 55.6, 55.7

[56] References Cited

U.S. PATENT DOCUMENTS 4,948,344 8/1990 Cygnor ..... 415/55.1
5,516,529 5/1996 Niederkofler et al. ..... 415/55.1
5,551,842 9/1996 Schmid et al. ..... 415/55.1

FOREIGN PATENT DOCUMENTS 40 20 521 A1 1/1992 Germany .

*Primary Examiner*—Edward K. Look
*Assistant Examiner*—Richard Woo
*Attorney, Agent, or Firm*—Michael J. Striker

[57] ABSTRACT

The unit has a conveying pump embodied as a flow pump (10) with an impeller wheel (12) rotating in a pump chamber (24) and having respectively a crown of vanes (32) on both of its front faces which, together with grooves (38, 24) in the shape of a partial circle arranged in the front walls (26, 28) delimiting the pump chamber (24), respectively constitute a lateral conveying channel (44). The vanes (50) of the impeller wheel (12) are connected by an outer ring (36) on their radially outer ends. The outer ring (36) of the impeller wheel (12) also has a crown of vanes (50) which, together with the grooves in the shape of a partial circle arranged in the front walls (26, 28), respectively constitute an outer flow channel (58). Over a portion of their circumference the outer flow channels (58) are connected with the conveying channels (44) and, together with them, a pressure build-up in the direction of rotation (11) of the impeller wheel (12) approximately corresponding to the pressure build-up in the conveying channels (44) takes place, so that there is essentially no pressure difference between them, by means of which the entry of dirt into the area between the outer ring (36) of the impeller wheel (12) and the front walls (26, 28) is prevented.

14 Claims, 5 Drawing Sheets

EQUIPMENT FOR PUMPING FUEL FROM A STORAGE TANK TO THE INTERNAL-COMBUSTION ENGINE OF A MOTOR VEHICLE

BACKGROUND OF THE INVENTION

The invention relates to a unit in accordance with the species of claim 1 for conveying fuel from a tank to the internal combustion engine of a motor vehicle.

Such a unit is known from DE 40 20 521 A1. This unit has a conveying pump designed in the form of a flow pump, whose impeller wheel, which is rotatingly driven by a drive element, turns in a pump chamber. The pump chamber is delimited in the direction of the axis of rotation of the impeller wheel by two oppositely located front walls, and in the radial direction in relation to the axis of rotation by an annular wall. On both its front faces, the impeller wheel respectively has a crown of vanes. At the two front walls, grooves are arranged around the axis of rotation of the impeller wheel at the height of the vanes respectively extending over a portion of the circumference which, together with the vanes of the impeller wheel, respectively constitute a conveying channel. The conveying channels lead from an inlet opening on their one end to an outlet opening at their other end. The impeller wheel has an outer ring connecting its vanes at their outward extending ends. With this embodiment of the unit it has been shown that, because of convection, the entry of dirt particles into the space between the outer ring of the impeller wheel and the annular walls through axial gaps existing between the front ends of the impeller wheel and the front ends cannot be ruled out. This is caused by a build-up of pressure occurring in the conveying circuits in the direction of rotation of the impeller wheel, so that therefore a higher pressure exists there than in the space between the outer ring of the impeller wheel and the annular wall, becauseof which an amount of leakage flows from the conveying channels into the annular space. Entry of dirt particles into this chamber can lead to increased wear of the unit and should therefore be avoided.

SUMMARY OF THE INVENTION

In contrast thereto, the unit in accordance with the invention for conveying fuel from a reservoir to the internal combustion engine of the motor vehicle has the advantage that a pressure build-up in the direction of rotation of the impeller wheel also takes place through the at least one flow channel in the space between the outer ring of the impeller wheel and the annular wall, and therefore a pressure difference between the at least one flow channel and the conveying channels is prevented or at least reduced, and thus the amount of leakage between the conveying channels and the annular chamber is prevented or at least reduced. Furthermore, the entry of dirt particles into this space is reduced.

Advantageous embodiments and further developments of the unit are recited in the dependent claims. By means of the embodiment it is achieved that a pressure build-up takes place in the at least one flow channel which approximately corresponds to the pressure build-up in the conveying channels. By means of the embodiment in accordance with claim 6 it is possible to affect the pressure build-up in the at least one flow channel.

BRIEF DESCRIPTION OF THE DRAWINGS

Three exemplary embodiments of the invention are represented in the drawings and explained in more detail in the following description.

DESCRIPTION OF THE PREFERRED EMBODIMENTS

Figure 1:
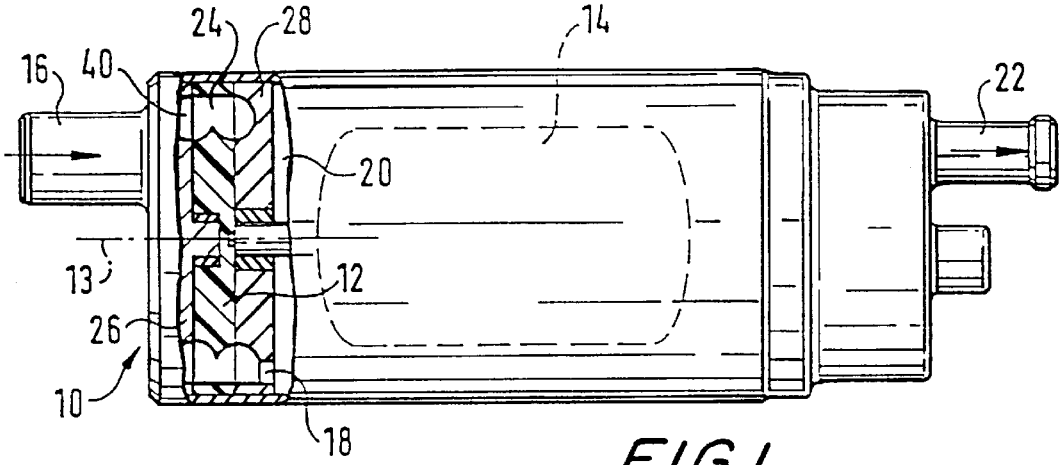
FIG. 1 shows a unit for conveying fuel by means of a flow pump in axial longitudinal section, FIG. 2, portions of the flow pump in accordance with a first exemplary embodiment in an enlarged representation in an axial cross section, FIG. 3, the flow pump in a cross section along the lines III—III in FIG. 2, FIG. 4, portions of the flow pump in a modified embodiment in cross section, FIG. 5, portions of the flow pump in a further modified embodiment, FIG. 6, portions of the flow pump in accordance with a second exemplary embodiment in longitudinal section, FIG. 7, the flow pump in cross section along the lines VII—VII in FIG. 6, FIG. 8, the flow pump in cross section in a modified embodiment, FIG. 9, portions of the flow pump in longitudinal section in accordance with a third exemplary embodiment, and FIG. 10, the flow pump in cross section along the lines X—X in FIG. 9.
Figure 2:
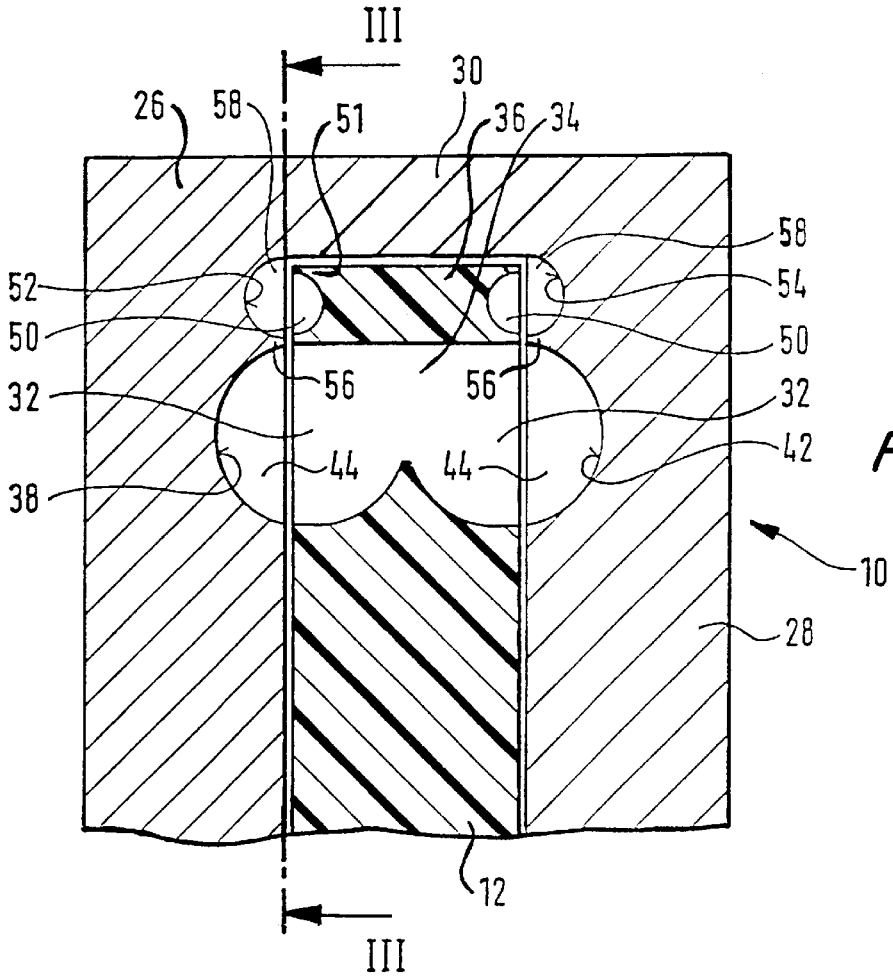

A unit, shown in simplified form in FIG. 1, is used for conveying fuel from a tank, not shown, to the internal combustion engine, also not shown, of a motor vehicle. The fuel-conveying unit has a flow pump 10, whose impeller wheel 12 is rotatingly driven by an electrical drive motor 14. In the course of operation of the fuel conveying unit, the flow pump 10 aspirates fuel through an aspirating connector 16 and pushes it through a pump outlet 18 in a wall, to be explained in more detail later, into a chamber 20, in which the drive motor 14 is disposed. From there, the fuel is supplied to the internal combustion engine via a pressure connector 22 and a fuel line, not represented.

The flow pump 10 is represented enlarged in FIGS. 2 to 10. The impeller wheel 12 of the flow pump 10 rotates in a pump chamber 24, which is delimited in the direction of the axis of rotation 13 of the impeller wheel 12 by respectively one front wall 26 and 28, and which is delimited in the radial direction in relation to the axis of rotation 13 by an annular wall 30. In this case the front wall 26 can constitute a cover of the fuel conveying unit, on which the aspirating connector 16 is arranged. The other front wall 28 can constitute a separating wall toward the chamber 20 and can have the pump outlet 18 in the form of an outlet opening. On its circumference, the impeller wheel 12 respectively has a crown of vanes 32, which are arranged spaced apart and oriented radially outward, on both of its front faces. The vanes 32 have been formed in that strips remain between cut-outs 34 arranged on a common graduated circle around the axis of rotation 13 and delimit the cut-outs 34 in the circumferential direction of the impeller wheel 12. The vanes 32 are connected with each other by a closed outer ring 36 on their radially outer ends.

Figure 3:
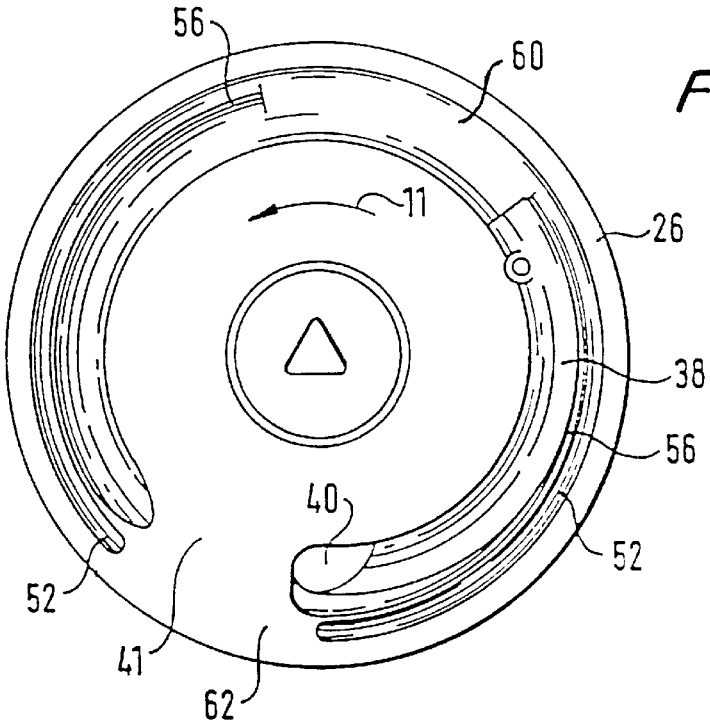

As represented in FIG. 3, a groove 38 is arranged in the front wall 26 facing the impeller wheel 12, which extends as a partial ring over the axis of rotation 13 of the impeller wheel 12 at the height of the vanes 32 of the impeller wheel 12, and on whose start, viewed in the direction of rotation 11 of the impeller wheel 12, an inlet opening 40 connected with the aspirating connection 16 terminates. At a a circumferential area 41, viewed in the direction of rotation 11 of the impeller wheel 12, the groove 38 is interrupted between its end and its start. A groove 42 is also arranged, mirror-inverted in relation to the front wall 26, in the front wall 28 facing the impeller wheel 12, which also extends as a partial circle around the axis of rotation 13 of the impeller wheel 12 at the height of the vanes 32 of the impeller wheel 12, from whose end, viewed in the direction of rotation 11 of the impeller wheel 12, the pump outlet 18 leads off. Viewed in a circumferential area in the direction of rotation 11 of the impeller wheel 12, the groove 42 is also interrupted between its end and its start. Together with the vanes 32 of the front faces of the impeller wheel 12 facing them, the grooves 38 and 42 respectively constitute a conveying channel 44, in which fuel is conveyed from the inlet opening 40 to the outlet opening 18 during the operation of the fuel conveying unit. Thus, the flow pump 10 is designed as a side-channel pump, since the conveying channels 44 are only formed laterally next to the impeller wheel 12 and do not extend over the exterior circumference of the impeller wheel 12.

In connection with an exemplary embodiment of the flow pump 10 represented in FIGS. 2 to 5, the impeller wheel 12 has in its outer ring 36, respectively in its front faces facing the front walls 26, 28, a crown of vanes 50, which are spaced apart from each other in the circumferential direction. On their radially outer ends the vanes 50 are connected with each other by means of a further ring 51, which delimits the impeller wheel 12 radially outward. In this case, the radially outer ends of the vanes 50 can be advanced, preferably by approximately 25° to 50°, for minimizing mechanical flow energy losses in the direction of rotation 11 of the impeller wheel 12. In this connection, reference is made to German Patent Application 195 04 079, whose contents are to be made part of the contents of the instant application. In this case, the front walls 26, 28 respectively have a groove 52, or respectively 54, which extends in a partial ring around the axis of rotation 13 of the impeller wheel 12 at the height of the vanes 50. Here, the grooves 52, or respectively 54, extend at least approximately over nearly the same circumference as the grooves 38, or respectively 42, which contribute to forming the conveying channels 44, of the front walls 26, 28, wherein the grooves 52, or respectively 54 can also extend over a smaller or greater circumference than the grooves 38, or respectively 42. Over a portion of their circumference, the outer grooves 52, 54 are separated by strips 56 of the front walls 26, 28 from the inner grooves 38, 42. Together with the vanes 50 of the front faces of the outer ring 36 of the impeller wheels 12 facing them, the grooves 52, 54 respectively constitute an outer flow channel 58. A pressure build-up, which at least approximately corresponds to the pressure build-up in the conveying channels 44, is intended to take place in the outer flow channel 58 when the fuel conveying unit is operated.

Figure 4:
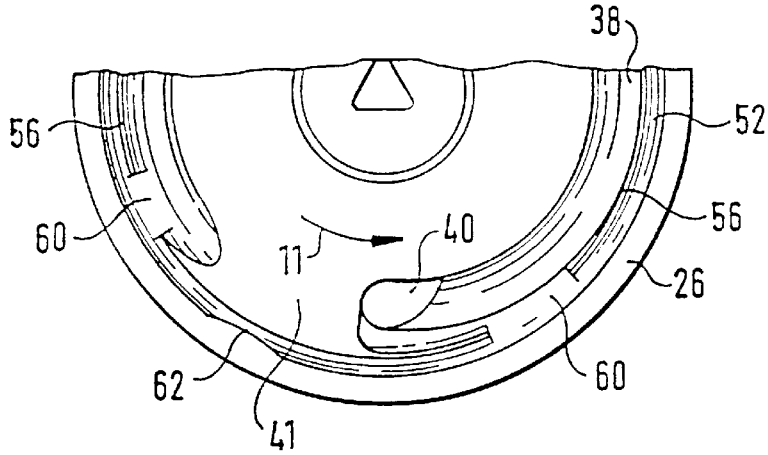
Figure 5:
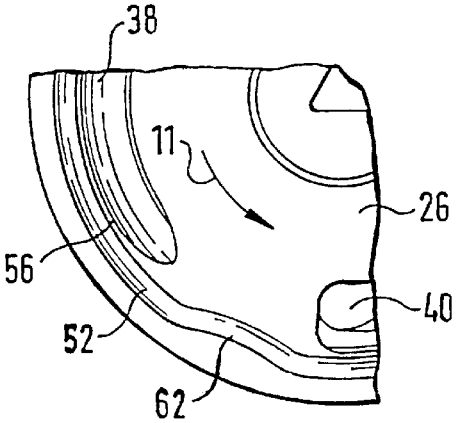

The outer flow channels 58 are connected with the conveying channels 44, which are respectively arranged inside of them, over a portion of their circumference. In this case it can be provided that the grooves 52, 54, which contribute to forming the outer flow channels 58, are connected with the inner grooves 38, 42, which contribute to forming the conveying channels 44, in the area of their start, viewed in the direction of rotation 11 of the impeller wheel 12, and/or in the area of their end, viewed in the direction of rotation 11 of the impeller wheel 12. As represented in FIG. 4, this connection can also take place by one or several cut-outs 60 interrupting the strips 56. A connection with the inner grooves 38, 42 is preferably provided at the start as well as at the end of the outer grooves 52, 54, so that approximately the same pressure conditions occur at the start and at the end of the outer flow channels 58 as at the start and at the end of the inner conveying channels 44. As represented in FIG. 3, the connection of the outer grooves 52, 54 with the inner grooves 38, 42 can also alternatively take place in a central circumferential area between their start and their end by means of one or several cut-outs 60 interrupting the strips 56. In this case the width, depth and position of the cut-outs 60 is determined in such a way that advantageous flow conditions result between the grooves and a pressure equalization occurs between them.

The outer flow channels 58 are interrupted or at least constricted in the circumferential areas 62 between their ends and starts, viewed in the direction of rotation 11 of the impeller wheel 12. In this case the circumferential areas 62 essentially correspond to the circumferential areas 41 in which the inner grooves 38, 42 are interrupted, but can also be somewhat larger or somewhat smaller than these. In an embodiment represented in FIG. 3, the outer grooves 52, 54 are completely interrupted in the circumferential areas 62 between their starts and ends, viewed in the direction of rotation 11 of the impeller wheel 12. In a modified embodiment represented in FIG. 4, the grooves 52, 54 are constricted in the circumferential area 62. For example as represented, in this case a constriction can be provided in the radial direction 6, i.e. of the width of the grooves and/or in the direction of the axis of rotation 13 of the impeller wheel 12, i.e. the depth of the grooves 52, 54. In a further modified embodiment represented in FIG. 5, in the circumferential area 62 the grooves 52, 54 continue to extend offset, for example radially, in respect to their remaining circumference, so that in this case there is no or only a slight coincidence with the vanes 50 of the outer ring 36 of the impeller wheel 12 provided, and the flow channels 58 are correspondingly interrupted or at least constricted.

Together with the grooves 52, 54, the vanes 50 of the outer ring 36 of the impeller wheel 12 constitute a further flow pump, which is also a side-channel pump, since the conveying channels 58 are only arranged laterally next to the impeller wheel 12 and do not have a connection via the ring 51 at the outer circumference of the impeller wheel 12. However, this further flow pump is not connected downstream of the first, inner flow pump as in connection with known, multi-stage conveying pumps, but instead conveys parallel, so to speak, with it from the same inlet opening 40 to the same outlet opening 18. When operating the fuel conveying unit, conveyance of fuel also takes place in the flow channels 58 by means of the vanes 50 disposed on the outer ring 36 of the impeller wheel 12. It is possible to affect the amount of fuel conveyed, the dependency of the amount of fuel conveyed from the rpm of the impeller wheel 12, and the progression of the pressure increase over the circumference of the flow channels 58, by the design of the vanes 50 and the grooves 52, 54, as well as the design of the interruption, or respectively constriction, of the flow channels 58, so it is possible to achieve a desired amount of conveyance and a desired pressure build-up.

Figure 6:
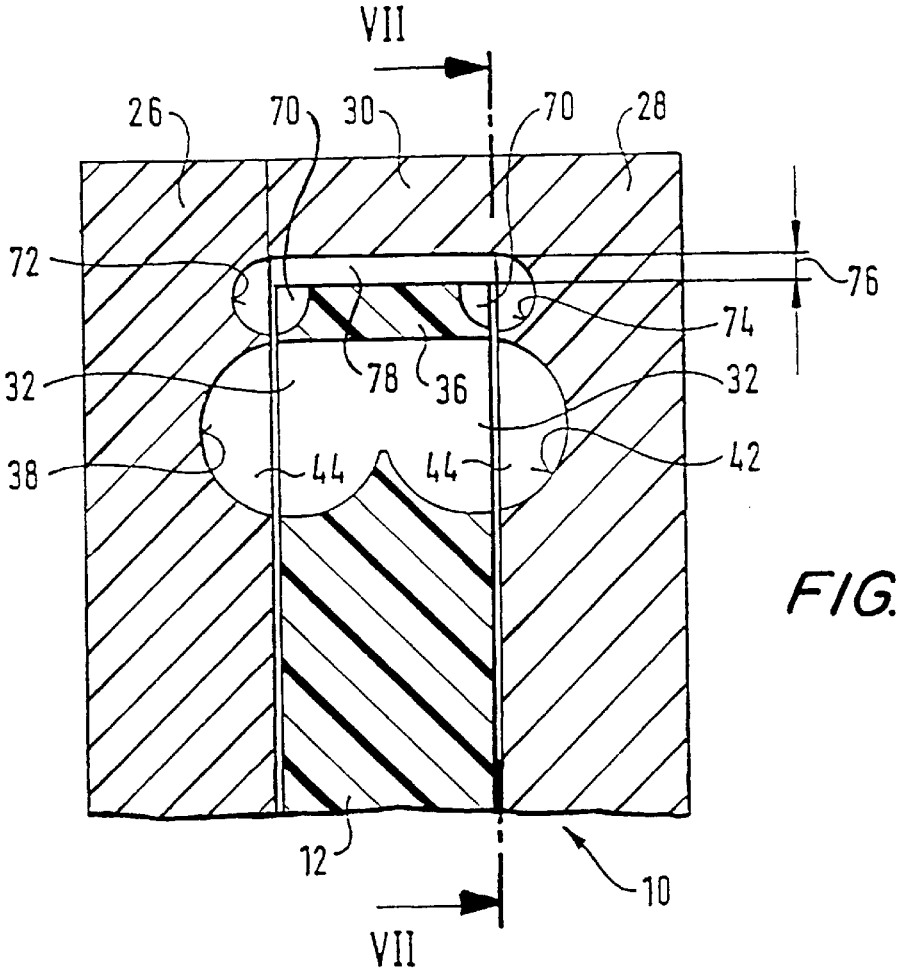
Figure 7:
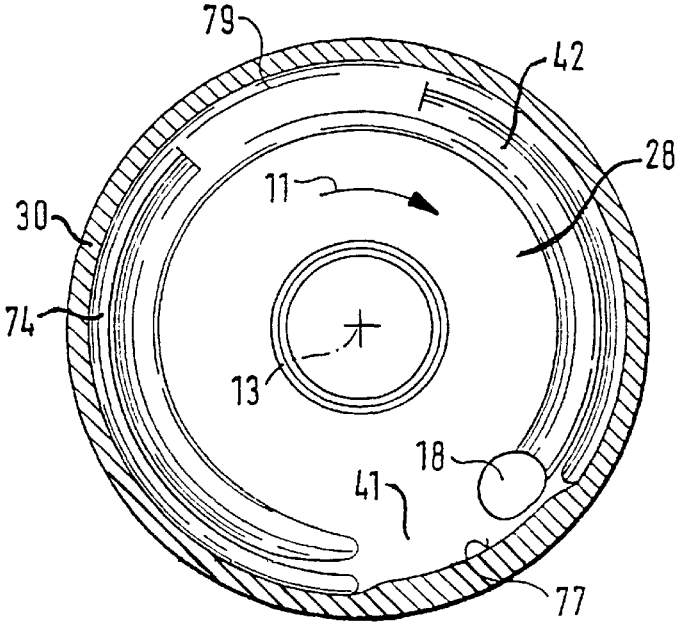
Figure 8:
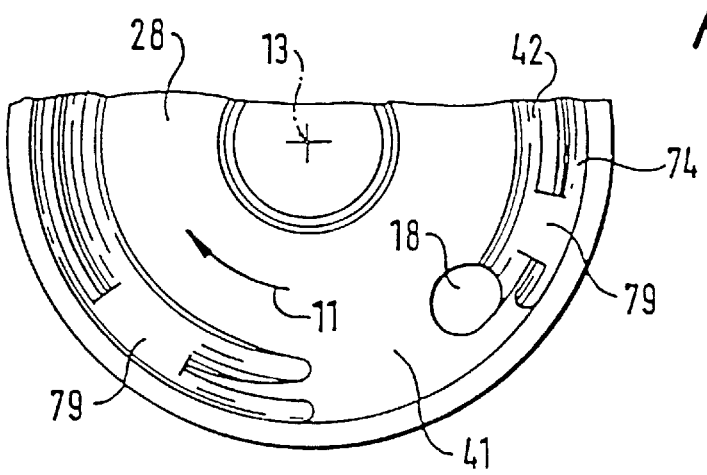

The flow pump 10 in accordance with a second exemplary embodiment is represented in FIGS. 6 to 8. Here, too, the impeller wheel 12 respectively has a crown of vanes 70, spaced apart from each other in the circumferential direction, on the front faces of its outer ring 36 facing the front walls 26, 28 which, however, different from the first exemplary embodiment, extend approximately slightly radially, for example, at the outer circumference of the outer ring 36 of the impeller wheel 12. In this case, the front walls 26, 28 have a groove 72, or respectively 74, respectively extending in a partial ring around the axis of rotation 13 of the impeller wheel 12 at the height of the vanes 70. Here, the grooves 72, or respectively 74, extend at least approximately over nearly the same circumference as the grooves 38, or respectively 42, which contribute to forming the conveying channels 44, of the front walls 26, 28, but can also extend over a smaller or greater circumference than these. A radial gap 76 remains between the outer circumference of the outer ring 36 of the impeller wheel 12 and the annular wall 30, through which the grooves 72, 74 are connected with each other over the outer circumference of the outer ring 36 of the impeller wheel 12. An outer flow channel 78 is formed by the vanes 70 of the outer ring 36 of the impeller wheel 12 and the grooves 72, 74 and the gap 76. The outer flow channel 78 is also interrupted or at least constricted in the circumferential area 41, in which the inner conveying channels 44 are interrupted. The front wall 28 with the grooves 42 and 74 is represented in FIGS. 7 and 8, wherein the front wall 26 is embodied mirror-inverted from the grooves 38 and 72. As represented in FIGS. 7 and 8, the grooves 72, 74 in the front walls 26, 28 can be interrupted in the circumferential area 41, or their width and/or depth can at least be reduced. In addition or alternatively, the radial gap 76 can also be reduced in the circumferential area 41, as is the case with the modified embodiment represented in FIG. 7. A reduction of the gap 76 can be achieved by a protrusion 77, radially projecting inward away from the annular wall 30.

As with the first exemplary embodiment, in the second exemplary embodiment the outer flow channel 78 is also connected with the inner conveying channels 44 in order to make a pressure equalization between them possible. As in the first exemplary embodiment, the connection can take place at the start and/or the end of the flow channel 78, or in a circumferential area located between them. One or several cut-outs 79 are provided in the intermediate walls 26, 28 for connecting the flow channel 78 with the conveying channels 44. In this case, the second conveying pump constituted by the vanes 70 of the outer ring 36 of the impeller wheel 12 and the flow channel 78 is a combined side-channel and peripheral pump, since the flow channel 78 extends laterally next to the outer ring 36 of the impeller wheel 12 as well as over its exterior circumference. The vanes 70 of the impeller wheel 12, the dimensions of the flow channel 78 as well as the interruption, or respectively the constriction of the flow channel 78, are matched in such a way that a pressure build-up approximately corresponding to the pressure build-up in the conveying channels 44 and a predetermined amount of fuel conveyance result in the flow channel 78 in the direction of rotation of the impeller wheel 12.

Figure 9:
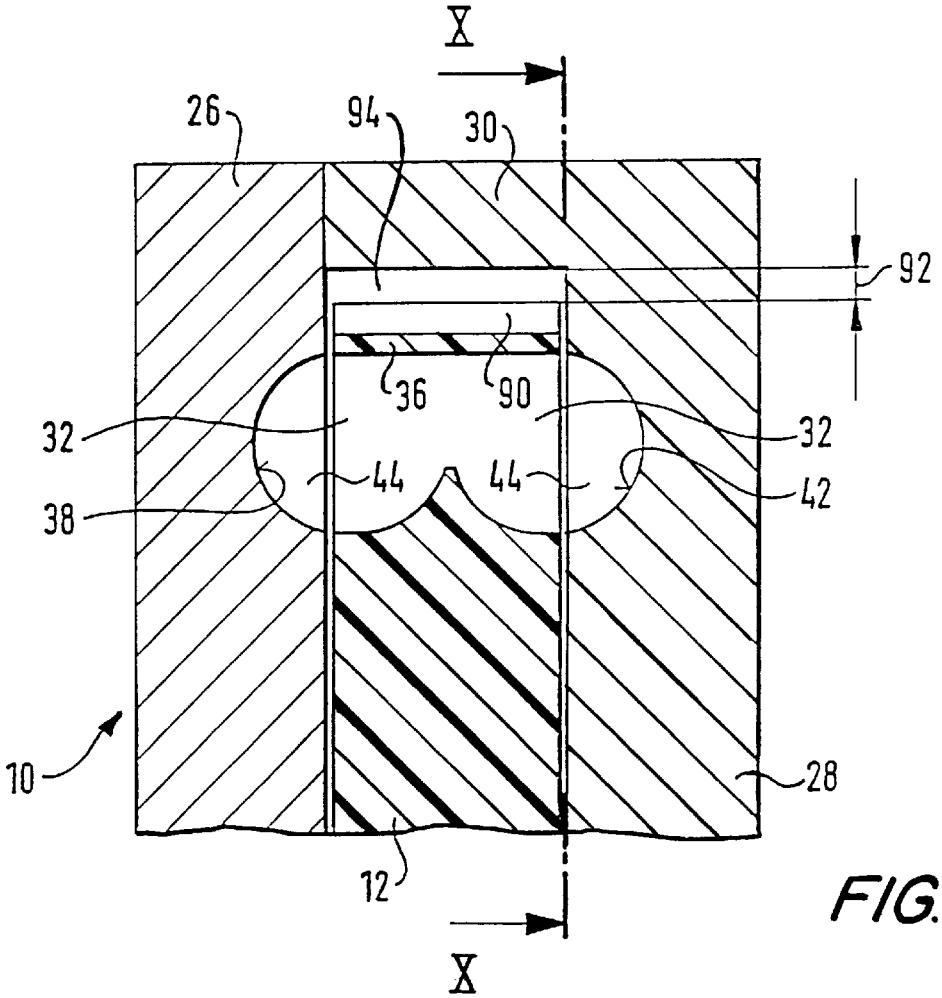
Figure 10:
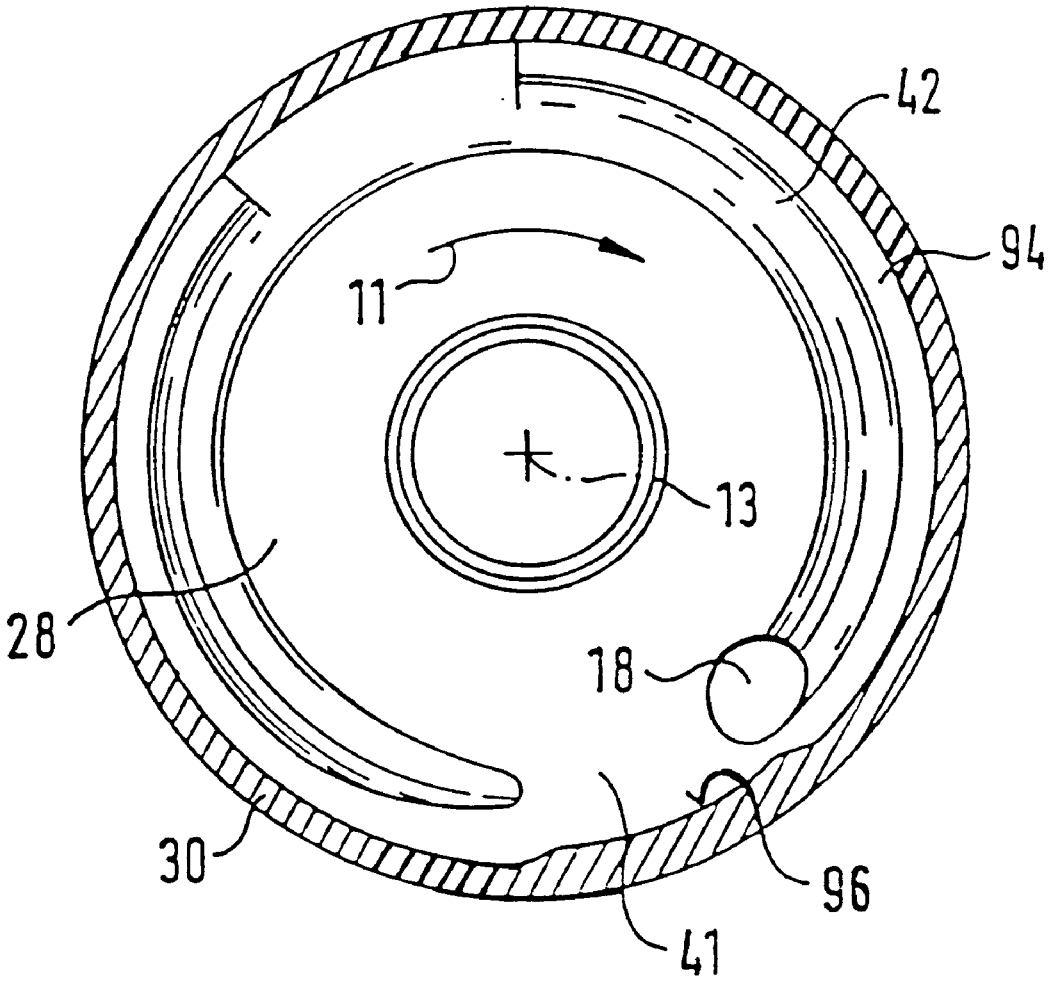

The flow pump in accordance with a third exemplary embodiment is represented in FIGS. 9 and 10. In this case, too, the impeller wheel 12 has a crown of vanes 90 on its outer ring 36, spaced apart from each other in the circumferential direction and projecting radially outward from the outer ring 36. The vanes 90 can extend continuously over the entire width of the impeller wheel 12, or one crown of vanes 90 can be arranged on each of the two front faces of the ring 36 of the impeller wheel 12. A radial gap 92 remains between the radially outer ends of the vanes 90 and the annular wall 30 which, together with the vanes 90 of the outer ring 36 of the impeller wheel 12, constitutes a flow channel 94. Again, the flow channel 94 extends over the same circumference as the inner conveying channels 44, but can also extend over a slightly greater or slightly lesser circumference as the inner conveying channels 44. Between its end and its start, viewed in the direction of rotation 11 of the impeller wheel 12, the flow channel 94 is interrupted or at least constricted in the same circumferential area 41 as the inner grooves 38, or respectively 42. The interruption or constriction of the flow channel 94 can be provided in that the radial gap 92 is more or less strongly constricted, which can take place by means of a protrusion 96 extending radially inward from the annular wall 30. The front wall 28 with the groove 42 is represented in FIG. 10, wherein the front wall 26 with the groove 38 is embodied in a mirror-inverted manner.

The flow channel 94 of the flow pump in accordance with the third exemplary embodiment is also connected with the inner conveying channels 44. The connection can take place in the area of the start and/or the end, viewed in the direction of rotation 11 of the impeller wheel 12, of the flow channel 94, or in a circumferential area arranged between them. As in the first two exemplary embodiments, the connection of the flow channel 94 with the inner conveying channels 44 can be provided by means of one or several cut-outs in the front walls 26, 28. In this case, the vanes 90 of the impeller wheel 12, the dimensions of the flow channel 94 as well as the interruption, or respectively the constriction of the flow channel 94, can be matched in such a way that a pressure build-up approximately corresponding to the pressure build-up in the conveying channels 44 and a predetermined amount of fuel conveyance result in the flow channel 94 in the direction of rotation of the impeller wheel 12.

We claim:

1. A unit for conveying fuel from a tank to the internal combustion engine of a motor vehicle, with a conveying pump (10) embodied as a flow pump, whose impeller wheel (12), which is rotatingly driven by a drive element (14), turns in a pump chamber (24), which is delimited in the direction of the axis of rotation (13) of the impeller wheel (12) by two oppositely located front walls (26, 28), and in the radial direction in relation to the axis of rotation (13) of the impeller wheel (12) by an annular wall (30), wherein the impeller wheel (12) respectively has a crown of vanes (32) on both its front faces, which are spaced apart from each other in the circumferential direction and are oriented radially outward, and wherein a groove is respectively arranged at the two front walls (26, 28), extending in the shape of a partial ring around the axis of rotation (13) of the impeller wheel (12) at the height of the vanes (32) which, together with the vanes (32) of the impeller wheel (12), respectively constitute a conveying channel (44), which, viewed in the direction of rotation (11) of the impeller wheel (12), lead from an inlet opening (40) on their start to an outlet opening (18) at their end, and wherein the impeller wheel (12) has an outer ring (36) connecting its vanes (32) at their radially outer ends, characterized in that a further crown of vanes (50, 70, 90) is arranged on the outer ring (36) of the impeller wheel (12), which are spaced apart from each other in the circumferential direction and are oriented radially outward and which, together with the front walls (26, 28) and with the annular wall (30) constitute at least one flow channel (58, 78, 94) extending at least in the form of a partial ring around the axis of rotation (13) of the impeller wheel (12), in which a pressure build-up in the direction of rotation (11) of the impeller wheel (12) takes place.

2. The unit in accordance with claim 1, characterized in that the at least one flow channel (58, 78, 94) is connected over a portion of its circumference with the conveying channels (44), so that a pressure build-up approximately corresponding to the pressure build-up in the conveying channels (44) takes place in it.

3. The unit in accordance with claim 2, characterized in that the at least one flow channel (58, 78, 94) is connected in the area of at least one of its start and its end, viewed in the direction of rotation (11) of the impeller wheel (12), with the conveying channels (44).

4. The unit in accordance with claim 2, characterized in that the at least one flow channel (58, 78, 94) is connected in its circumferential area between its start and end, viewed in the direction of rotation (11) of the impeller wheel (12), with the conveying channels (44).

5. The unit in accordance with claim 1 characterized in that the at least one flow channel (58, 78, 94) is interrupted or at least constricted in first circumferential area (62) between its start and end, viewed in the direction of rotation (11) of the impeller wheel (12).

6. The unit in accordance with claim 5, characterized in that in a second circumferential area (41, 43), which is at least partially coincident with the first circumferential area (62) in which the at least one flow channel (58, 78, 94) is interrupted or at least constricted, the conveying channels (44) are also interrupted or at least constricted between their ends and starts, viewed in the direction of rotation (11) of the impeller wheel (12).

7. The unit in accordance with claim 5, characterized in that the interruption or at least constriction of the flow channels (58) is created by an interruption or at least constriction of the grooves (52, 54).

8. The unit in accordance with claim 5, characterized in that the interruption or at least constriction of the flow channels (58) is created by a radial offset of the grooves (52, 54) in relation to the vanes (50), so that they do not coincide with the vanes (50).

9. The unit in accordance with claim 5, characterized in that the interruption or at least constriction of the flow channel (94) is created by at least one protrusion (30), radially extending inward from the annular wall (96).

10. The unit in accordance with claim 5, characterized in that the flow channel (78) extends laterally next to the outer ring (36) of the impeller wheel (12), as well as over its outer circumference.

11. The unit in accordance with claim 10, characterized in that the interruption or at least constriction of the flow channel (78) is created by an interruption or at least constriction of its portion extending over the outer circumference of the outer ring (36) of the impeller wheel (12) by means of a protrusion (77), extending radially inward from the annular wall (30).

12. The unit in accordance with claim 10, characterized in that the interruption or at least constriction of the flow channel (78) is created by an interruption or at least constriction of its portion laterally extending next to the outer ring (36) of the impeller wheel (12) by means of its interruption or at least constriction.

13. The unit in accordance with claim 1, characterized in that a single flow channel (94) is formed over the outer circumference of the impeller wheel (12) between the front walls (26, 28) and the annular wall (30).

14. The unit in accordance with claim 1, characterized in that the vanes (50) of the outer ring (36) of the impeller wheel (12) are connected with each other at their radially outer ends by a further closed ring (51), and that a groove (52, 54), which respectively extends in the two front walls (26, 28), is disposed at the height of the vanes (50) in the shape of an at least partial ring around the axis of rotation (13) of the impeller wheel (12) which, together with the vanes (50), respectively forms a lateral flow channel (58).

* * * * *